US007201124B2

(12) United States Patent
Neubauer et al.

(10) Patent No.: US 7,201,124 B2
(45) Date of Patent: Apr. 10, 2007

(54) PHASE DISPLACEMENT DEVICE

(75) Inventors: Dirk Neubauer, Nachrodt-Wiblingwerde (DE); Markus Wilke, Nuertingen (DE)

(73) Assignee: AFT Atlas Fahrzeugtechnik GmbH, Werdohl (DE)

( * ) Notice: Subject to any disclaimer, the term of this patent is extended or adjusted under 35 U.S.C. 154(b) by 0 days.

(21) Appl. No.: 11/079,631

(22) Filed: Mar. 14, 2005

(65) Prior Publication Data

US 2005/0188935 A1 Sep. 1, 2005

Related U.S. Application Data

(63) Continuation of application No. PCT/DE03/02606, filed on Aug. 4, 2003.

(30) Foreign Application Priority Data

Sep. 13, 2002 (DE) ..... 102 42 660
Apr. 4, 2003 (DE) ..... 103 15 317

(51) Int. Cl.
*F01L 1/34* (2006.01)

(52) U.S. Cl. ..... 123/90.17; 123/90.15; 123/90.31; 123/90.11; 74/568 R

(58) Field of Classification Search ..... 123/90.11, 123/90.17
See application file for complete search history.

(56) References Cited

U.S. PATENT DOCUMENTS 3,978,829 A 9/1976 Takahashi et al.
5,174,253 A 12/1992 Yamazaki et al.
5,548,995 A * 8/1996 Clinton et al. ..... 73/116
5,680,837 A * 10/1997 Pierik ..... 123/90.17
5,715,780 A 2/1998 Haller
5,736,633 A * 4/1998 Magner et al. ..... 73/116
6,129,061 A * 10/2000 Okuda et al. ..... 123/90.17
6,135,078 A * 10/2000 Doi et al. ..... 123/90.18
6,505,587 B1 * 1/2003 Scheidt ..... 123/90.17
6,523,512 B2 * 2/2003 Axmacher et al. ..... 123/90.17
6,766,775 B2 * 7/2004 Riedle et al. ..... 123/90.15
2002/0096947 A1 * 7/2002 Namai ..... 310/68 B
2003/0226532 A1 * 12/2003 Takenaka et al. ..... 123/90.17

FOREIGN PATENT DOCUMENTS

| | | |
|---|---|---|
| DE | 44 40 656 | 5/1995 |
| DE | 197 42 114 | 3/1999 |
| DE | 100 13 877 | 9/2001 |
| DE | 100 38 354 | 2/2002 |
| DE | 101 48 059 | 4/2003 |
| JP | 59 153 909 | 9/1984 |
| JP | 07 324 607 | 12/1995 |
| WO | WO 01/98878 | 12/2001 |

* cited by examiner

*Primary Examiner*—Thomas Denion
*Assistant Examiner*—Kyle M. Riddle
(74) *Attorney, Agent, or Firm*—Volpe & Koenig, P.C.

(57) ABSTRACT

A phase displacement device (1) having a drive (2) with a drive shaft (4) and a transmission (5) for displacing the phase between a camshaft (9) and a crankshaft (12) is provided. The phase displacement device (1) has a sensor device (14, 15, 16, 17, 18, 19) with which the rotational speed or the position of a component (2, 3, 4, 5, 6) of the phase displacement device (1) is measured. In this way, a higher resolution is achieved with respect to the position of the camshaft.

11 Claims, 2 Drawing Sheets

PHASE DISPLACEMENT DEVICE

BACKGROUND

The present invention relates to a phase displacement device for displacing the angle of rotation of a camshaft in relation to the angle of rotation of a crankshaft.

In internal combustion engines, the crankshaft drives one or more camshafts via a primary drive formed for example as a toothed belt. For this purpose, a camshaft wheel is fastened on each camshaft via which the primary drive drives the camshaft. At each point in time, there takes place a geared conversion of the angle of rotation of the crankshaft, such that an angle of rotation $\phi_K$ of the crankshaft of 720° is converted into an angle of rotation $\phi_N$ of the camshaft of 360°. The ratio of the two angles of rotation is constant through this coupling. In most applications, this fixed coupling between the camshaft and the crankshaft has a ratio of:

$$\phi_N(t)/\phi_K(t)=2.$$

However, the operating characteristics of an internal combustion engine can be optimized, in particular with respect to fuel consumption, the emission of exhaust gases, and smooth running performance, if the system, coupled via the primary drive, between the camshaft and the crankshaft can be modified, thus displacing the phase between the two shafts.

In DE 100 38 354 A1, in order to sense the phase displacement, sensor devices are attached to the camshaft and the crankshaft or to the camshaft wheel; these sensor devices sense the actual position of the camshaft in relation to the actual position of the crankshaft or of the camshaft wheel, and from this the positions, or also the rotational speeds, of the shafts can be determined. Such a sensor device can for example be realized by Hall sensors that operate in contactless fashion.

A disadvantage of such a design is that discrete angular marks must be attached to the camshaft and to the crankshaft which can then be picked up by the sensors. The number of these angular marks on the camshaft is dependent on the number of cylinders or on the periodic camshaft moment of alternation. Because it is not possible to place arbitrarily many angular marks on the camshaft, the measurement precision of the position acquisition is dependent on the space between adjacent angular marks. The longer the time interval required for the sensing of two adjacent angular marks, the more imprecise the measurement result is; i.e., the phase displacement cannot be determined precisely.

SUMMARY

The objective of the present invention is to provide a phase displacement device that determines a precise measurement value for the phase displacement even at low rotational speeds, or even when the crankshaft is standing still, thus making it possible to control the phase displacement to the desired value even at lower rotational speeds.

According to the present invention, this objective is achieved in that additional sensors are attached directly to or in the phase displacement device, said device comprising a drive and a transmission having a high gear ratio in relation to the camshaft, a high gear ratio meaning that at least during the displacement, and depending on the direction of the displacement, the rotational speed of the sensed part of the phase displacement device is greater or smaller than the rotational speed of the camshaft by a multiple factor.

The advantages of the present invention are that a higher resolution can be achieved with respect to the position of the camshaft, because at least during the displacement, and depending on the direction of displacement, individual mechanical components of the phase displacement device have a displacement rotational speed that is higher or lower than the rotational speed of the camshaft. The sensors for such phase displacement devices can be integrated easily and economically. Such a design exhibits a high degree of quality in the measurement of the phase displacement. Using such phase displacement devices, internal combustion engines can be controlled precisely even at low rotational speeds or from a standing start.

Further advantageous developments result from the subclaims. The sensor on the phase displacement device can acquire either the position of the rotor of the electric motor, or else the position of a part of the transmission that has, during the displacement, a different rotational speed than the camshaft due to the gear ratio. For the determination of the position of the rotor of the electric motor, incremental sensors are particularly advantageous that can be attached both externally to the motor or, in many electric motors, are already integrated in the motor, for example as Hall sensors. Alternatively, i.e., without a discrete sensor mechanism, the position of the rotor can be inferred through the measurement of electrical quantities of the running electric motor, in particular the mutual induction voltage.

BRIEF DESCRIPTION OF THE DRAWINGS

In the following, the present invention is explained in more detail on the basis of exemplary embodiments as shown in the Figures.

DETAILED DESCRIPTION OF THE PREFERRED EMBODIMENTS

Figure 1:
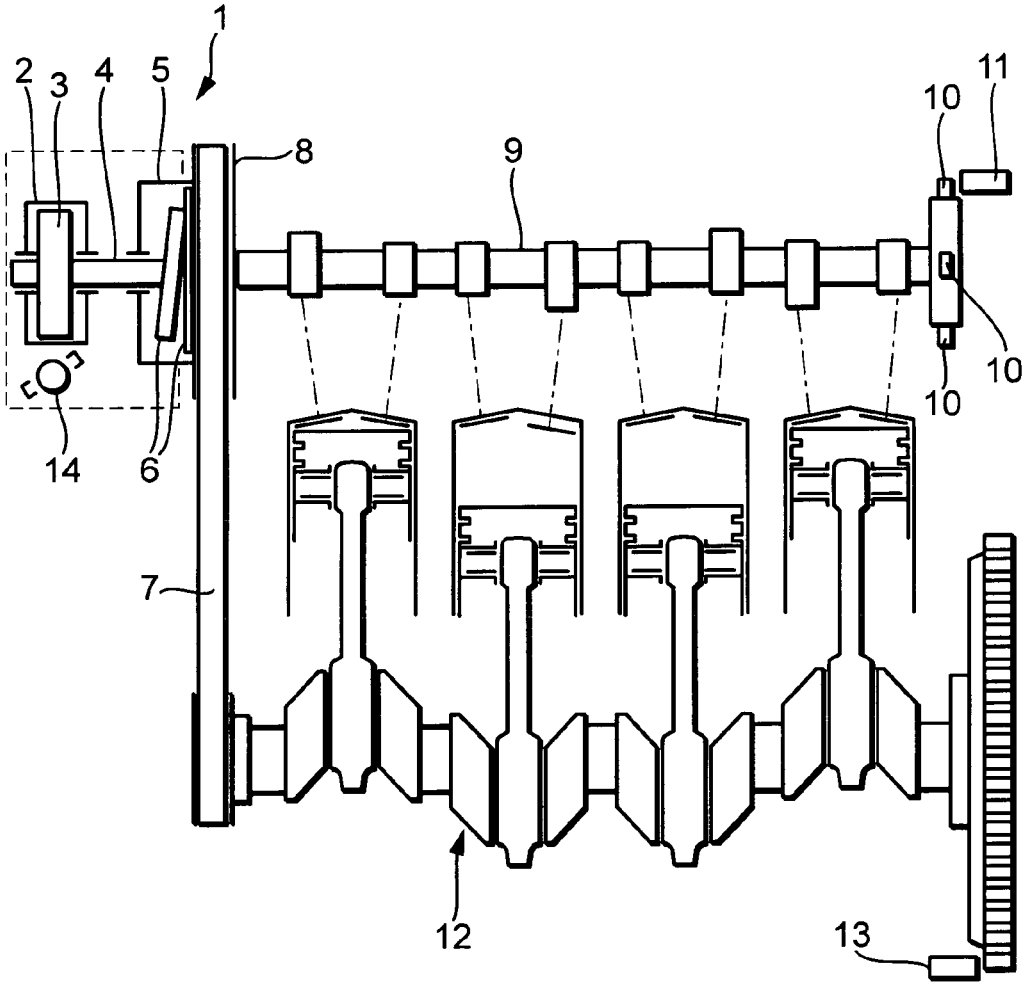
FIG. 1 is a view of a camshaft with a phase displacement device.

FIG. 1 shows a camshaft 9 with a phase displacement device 1. Here, a crankshaft 12 drives a camshaft wheel 8 via a primary drive 7. The respective position or rotational speed of the crankshaft 12 is acquired using a sensor 13. This position information is supplied to a control unit (not shown) and is provided for further processing. The crankshaft 12 drives the camshaft 9 via the primary drive 7 and the camshaft wheel 8 coupled thereto. The position or rotational speed of the camshaft 9 is also acquired with the aid of a sensor 11. For this purpose, in the exemplary embodiment four camshaft markings 10 are made on the camshaft, so that, for example, when the rotational speed of the crankshaft is known the elapsed time can be measured between the sensing of a crankshaft marking and the sensing of a camshaft marking. In a signal processing step (not shown), this time span can be converted to a phase displacement angle that represents the phase displacement between the camshaft 9 and the crankshaft 12 resulting from the phase displacement device 1. At low rotational speeds and/or a standstill of the crankshaft 12, the span of time between the acquisition of a crankshaft marking and the acquisition of a camshaft marking 10 is too large. With the camshaft sensor 11 and the crankshaft sensor 13 alone, at low rotational speeds the phase displacement cannot be determined, or can be determined only very imprecisely. For this reason, at least one additional sensor device 14 is situated on the phase displacement device 1 that can acquire various positions or rotational speeds of moving, in particular rotating or wobbling, components 3, 4, 6 in the phase displacement device. The phase displacement device 1 can act on the camshaft wheel 8 or can act directly on the camshaft 9, so that it is accelerated or delayed in relation to the primary drive 7, and thus also in relation to the crankshaft 12. If it is not desired for the phase displacement device 1 to have an influence on the camshaft 9, it is matched to the motion of the camshaft wheel 8. The phase displacement device 1 shown here contains a drive 2, 4 and a transmission 5, the transmission being moved by the electric motor 2 via a drive shaft 4. This transmission 5 acts on the camshaft wheel 8 and/or on the camshaft 9. The rotational speeds of components 3, 4, 6 on the electric motor 2 and in the transmission 5 of the phase displacement device 1 are proportional to the rotational speed of the camshaft. That is, if a component of the phase displacement device 1 changes its position, the position of the camshaft 9 is also changed in a predetermined manner. However, at least during the displacement, and dependent on the direction of displacement, the rotational speeds at the phase displacement device 1 are significantly higher or lower than the rotational speed of the camshaft 9. In the case of a phase displacement device 1 having wobble plate mechanisms, the relative rotational speed of the electric motor 2 during the displacement is approximately 60 times higher than the displacement rotational speed of the camshaft 9. If the number of rotations in the phase displacement device 1 is acquired, then it is possible even at low rotational speeds of the crankshaft 12 to determine the position of the camshaft 9, because then the high gear ratio (60:1 in the example shown) permits a fine measurement of the relative displacement of the camshaft. The determination of the phase displacement between the camshaft 9 and the crankshaft 12 can for example take place as follows:

- The current rotational speed of the crankshaft 12 is calculated from the crankshaft signals that arise when the crankshaft markings (not shown) are acquired by the sensor.
- The rotational speed of the camshaft wheel 8 is calculated from the crankshaft rotational speed.
- By means of the phase displacement device sensor 14, the rotational speed of a component 3, 4, 6 of the phase displacement device 1 is determined, and this is also used to calculate the angle of rotation of this component as an absolute or relative value.
- From the rotational speeds and/or the angles of rotation of a component 3, 4, 6 of the phase displacement device 1 and the primary drive 7, the relative rotation between this component 3, 4, 6 and the primary drive 7 is calculated.
- By means of the gear ratio of the phase displacement device, the relationship is known between:
  - the relative rotation between a component 3, 4, 6 of the phase displacement device 1 and the primary drive 7, and thus also the crankshaft 12,
  - with this, the relative rotation of the camshaft 9 in relation to the primary drive 7, and thus also in relation to the crankshaft 12 is known, yielding a first actual angle from the current phase position of camshaft 9 in relation to the crankshaft 12.
  - This first actual angle is now aligned with the actual angle of the sensor system from the camshaft sensor and the crankshaft sensor 11, 13, which form a second actual angle; this preferably takes place when the second actual angle has a sufficient quality due to a correspondingly high crankshaft rotational speed.

In the range of very low crankshaft rotational speeds, or at a standstill, the phase displacement can be measured by:

- bringing the phase displacement device 1 into a position that serves as a reference marking (the end stops of the phase displacement device 1 are particularly suitable for this);
- the determination of the actual angle and the controlling of the phase position then take place solely on the basis of the first actual angle.
- If the crankshaft rotational speeds increase again, the alignment with the second actual angle takes place again.

Figure 2:
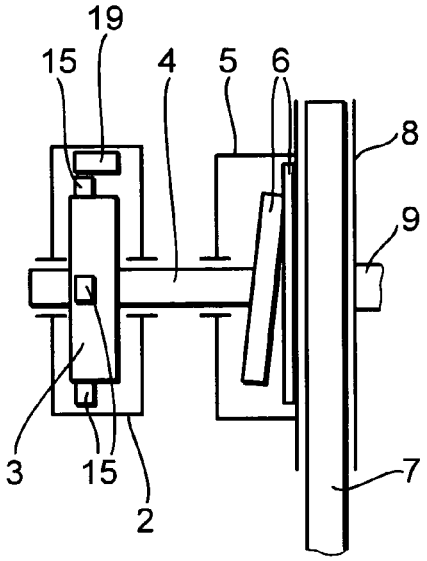
FIG. 2 is a view of a phase displacement device with an incremental sensor on the rotor of an electric motor.
Figure 3:
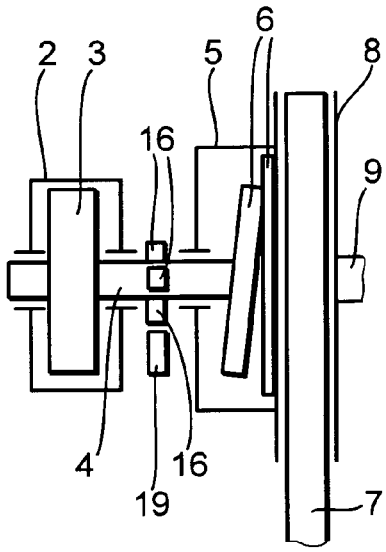
FIG. 3 is a view of a phase displacement device with an incremental sensor on the drive axle of an electric motor.
Figure 4:
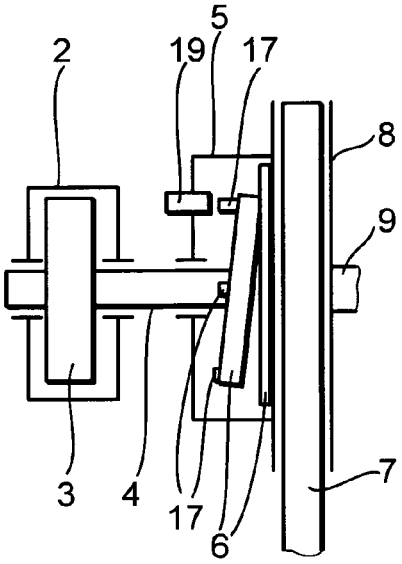
FIG. 4 is a view of a phase displacement device with an incremental sensor on a part of the transmission.

Such a sensor device 14 for acquiring the position of a component 3, 4, 6 of the phase displacement device can, as is shown in FIG. 2, have an incremental sensor 19 that acquires the motion of phase displacement device 1, for example via markings 15 on the rotor 3 of the electric motor 2. At least the number of rotations of the rotor 3 is acquired. Likewise, in the case of a plurality of markings 15 on the rotor 3, the position of the rotor 3 during a rotation can be specified more precisely. If the gear ratio between the rotor 3 and the camshaft 9 is known, and if this is for example 60:1, the position of the camshaft can be determined to approximately 1/60 within a rotation of the camshaft 9, even at low rotational speeds or at a standstill. An example of an incremental sensor 19 is the Hall sensor, which may for example already be integrated in the electric motor 2. External sensors for example in the form of photoelectric barriers can also be used for these measurements. These can also easily sense markings 15 that indicate a rotation or a particular position. Alternatively, as is shown in FIG. 3, such an incremental sensor 19 can be attached to the drive shaft 4 between the electric motor 2 and the transmission 5, or, as is shown in FIG. 4, can be attached directly to a transmission part 6. For this purpose, the corresponding parts then likewise have markings 16, 17 that can be measured by the corresponding sensor 19. In such phase displacement devices 1, it is important only that, in a manner conditioned by the transmission, a part 3, 4, 6 of the phase displacement device 1 whose rotational speed or position is being measured has a higher or lower rotational speed than the camshaft 9, at least during the displacement and depending on the direction of displacement.

Figure 5:
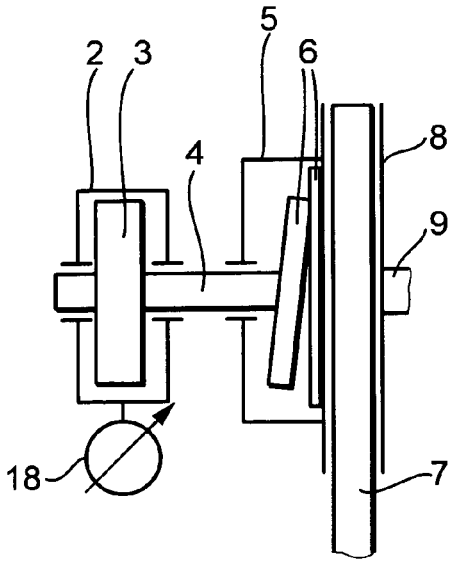
FIG. 5 is a view of a phase displacement device with a voltage measurement device on the electric motor.

In FIG. 5, it is shown that even without a discrete sensor mechanism the position of a rotating part 3 of the phase displacement device 1 can be determined. This takes place, for example in electronically commutated direct-current motors, in that the mutual induction voltage of the coil through which current is not flowing is measured. With this value, the rotational speed and/or the position of the rotor 3 in the electric motor 2 can then be sensed. For this purpose, a sensor 18 is provided for the measurement of an electrical quantity, in particular the mutual induction voltage, in the phase displacement device 1.

All other types of sensors and measurement methods with which the rotational speed and/or position of a component of the phase displacement device can be determined are also suitable for such a phase displacement device.

LIST OF REFERENCE CHARACTERS

1 phase displacement device
2 drive
3 electric motor rotor
4 drive shaft
5 transmission
6 component of the phase displacement device
7 primary drive
8 camshaft wheel
9 camshaft
10 camshaft marking
11 camshaft sensor
12 crankshaft
13 crankshaft sensor
14 phase displacement device sensor
15 marking on the rotor
16 marking on the drive shaft
17 marking on the transmission
18 sensor device
19 incremental sensor

The invention claimed is:

1. Phase displacement device for displacing a phase between a camshaft (9) and a crankshaft (12), the phase displacement device (1) comprising a transmission (5), an electric motor (2) having a rotor (3) and a drive shaft (4) driven by the rotor (3), a first sensor device (14, 18, 19) for measuring a rotational speed or a position of at least one of the drive shaft (4) and the rotor (3) of the electric motor (2), and a second sensor device (13) for measuring a rotational speed of the crankshaft (12) at least during phase displacement, whereby a first actual angle of the phase of the camshaft (9) relative to the crankshaft (12) is determined by values generated by the first sensor device (14, 18, 19) and the second sensor device (13), and a third sensor device (11) measures a rotational speed of the camshaft (9), wherein a second actual angle of the phase of the camshaft (9) relative to the crankshaft (12) is determined when the rotational speed of the crankshaft (12) is sufficiently high by the values generated by the second and third sensor devices (13, 11), whereby the first actual angle is aligned with the second actual angle if a second actual angle is determined.

2. Phase displacement device (1) according to claim 1 wherein rotations of the camshaft (9) in relation to the crankshaft (12) are calculated from relative rotational speeds or relative angles of rotation between the crankshaft (12) and the at least one of the drive shaft (4) and the rotor (3) of the phase displacement device (1), taking into account a gear ratio therebetween.

3. Phase displacement device (1) according to claim 1, wherein an angular alignment takes place between the first sensor device on the phase displacement device (1) and the camshaft (9).

4. Phase displacement device (1) according to claim 1 wherein the first sensor device has an incremental sensor (19) that acquires a movement of the rotor or the drive shaft (4) of the electric motor.

5. Phase displacement device (1) according to claim 4, wherein the incremental sensor (19) is a Hall sensor.

6. Phase displacement device (1) according to claim 5, wherein the sensor is a Hall sensor integrated in the electric motor (2).

7. Phase displacement device (1) according to claim 1, wherein the first sensor device has a sensor (18) for measuring an electrical quantity with which a rotational speed of the electric motor (2) is determined.

8. Phase displacement device (1) according to claim 7, wherein the electrical quantity measured by the sensor (18) is a mutual induction voltage of a currentless coil of the electric motor (2).

9. Phase displacement device (1) according to claim 1, wherein during displacement, parts of the phase displacement device (1) have a higher or lower rotational speed than a rotational speed of the camshaft (9), corresponding to a transmission gear ratio and according to a direction of displacement.

10. Phase displacement device (1) according to claim 1, wherein the first sensor device (14, 18, 19) is located within the phase displacement device (1).

11. Phase displacement device (1) according to claim 1, whereby sensor marks (15, 16, 17) are attached to or formed on the rotor (3) or the drive shaft (4) of the electric motor (2), and the first sensor device (14, 18, 19) is adapted to measure a rotational speed or a position of the rotor (3) or the drive shaft (4) component through detection of the sensor marks (15, 16, 17).

* * * * *